US007096696B2

(12) United States Patent
Devecki

(10) Patent No.: US 7,096,696 B2
(45) **Date of Patent: *Aug. 29, 2006**

(54) SCUBA TANK LOCK ASSEMBLY

(76) Inventor: Ronald W. Devecki, 2674 Kirk Rd., West Palm Beach, FL (US) 33406

( * ) Notice: Subject to any disclaimer, the term of this patent is extended or adjusted under 35 U.S.C. 154(b) by 0 days.

This patent is subject to a terminal disclaimer.

(21) Appl. No.: 11/178,188

(22) Filed: Jul. 8, 2005

(65) Prior Publication Data

US 2005/0241348 A1 Nov. 3, 2005

Related U.S. Application Data

(63) Continuation-in-part of application No. 11/007,532, filed on Dec. 7, 2004, now Pat. No. 6,966,205, which is a continuation-in-part of application No. 10/666,186, filed on Sep. 17, 2003, now Pat. No. 6,829,916.

(51) Int. Cl.
*E05B 73/00* (2006.01)

(52) U.S. Cl. ..... 70/18; 70/58

(58) Field of Classification Search ..... 70/14, 70/18, 30, 49, 58, 233; 248/551–553
See application file for complete search history.

(56) References Cited

U.S. PATENT DOCUMENTS

| | | | | | |
|---|---|---|---|---|---|
| 1,174,185 | A | | 3/1916 | Scott | |
| 1,274,203 | A | * | 7/1918 | Sager et al. | 211/4 |
| 2,122,897 | A | | 7/1938 | Straw | |
| 3,101,695 | A | * | 8/1963 | Honeyman, Jr. | 114/230.29 |
| 3,193,778 | A | | 7/1965 | Maynard | |
| 3,693,830 | A | | 9/1972 | Oglesbee | |
| 3,791,403 | A | | 2/1974 | Folkerth | |
| 3,841,118 | A | * | 10/1974 | Stone | 70/33 |
| 3,859,826 | A | * | 1/1975 | Singer et al. | 70/58 |
| 3,860,048 | A | | 1/1975 | White | |
| 3,987,653 | A | * | 10/1976 | Lyon et al. | 70/19 |
| 4,003,228 | A | * | 1/1977 | Lievens et al. | 70/58 |
| 4,055,973 | A | * | 11/1977 | Best | 70/58 |
| 4,212,175 | A | * | 7/1980 | Zakow | 70/58 |
| 4,570,465 | A | * | 2/1986 | Bennett | 70/18 |
| 4,573,584 | A | * | 3/1986 | Otema | 211/4 |
| 4,598,827 | A | * | 7/1986 | Keifer | 211/4 |
| 4,733,840 | A | * | 3/1988 | D'Amore | 248/205.3 |
| 4,979,382 | A | * | 12/1990 | Perry | 70/58 |
| 5,154,072 | A | * | 10/1992 | Leyden | 70/18 |
| 5,351,507 | A | * | 10/1994 | Derman | 70/18 |
| 5,398,530 | A | * | 3/1995 | Derman | 70/58 |
| 5,481,888 | A | * | 1/1996 | Perry | 70/18 |

(Continued)

*Primary Examiner*—Lloyd A. Gall
(74) *Attorney, Agent, or Firm*—McHale & Slavin PA

(57) ABSTRACT

A locking device comprises a locking plate having a first aperture to receive a cable lock, a second aperture having a slot extending therefrom, and a flat attachment cable having one end fixedly attached to the locking plate which is sized to be insertable into the second aperture for subsequent positioning in the slot. Cable crimps on the attachment cable have a width greater than the width of the slot. A locking device is provided which prevents movement of the cable crimps through the aperture when placed in a locked position. In use, the locking device is placed in an unlocked position, and the flat attachment cable is wrapped around an item to be locked and then inserted into the second aperture such that a cable crimp passes through the second aperture and the attachment cable is transversed for placement into the slot, and the locking device is then locked.

25 Claims, 11 Drawing Sheets

U.S. PATENT DOCUMENTS 5,896,762 A * 4/1999 Iidaka et al. ..... 70/57.1
6,003,348 A * 12/1999 McCrea ..... 70/18
6,044,669 A * 4/2000 Levi ..... 70/18
6,167,734 B1 * 1/2001 Derman ..... 70/18
6,212,919 B1 * 4/2001 Gerow ..... 70/18
6,308,540 B1 * 10/2001 Lee ..... 70/58
6,360,405 B1 * 3/2002 McDaid et al. ..... 24/265 R
6,446,474 B1 * 9/2002 Tabacchi et al. ..... 70/16
6,510,717 B1 * 1/2003 Levi ..... 70/18
6,829,916 B1 * 12/2004 Devecki ..... 70/18
6,966,205 B1 * 11/2005 Devecki ..... 70/18
2003/0164009 A1 * 9/2003 Levi ..... 70/18
2004/0093914 A1 * 5/2004 Vito ..... 70/38 A

* cited by examiner

SCUBA TANK LOCK ASSEMBLY

RELATED APPLICATIONS

This invention is a continuation-in-part of application Ser. No. 11/007,532 filed Dec. 7, 2004, now U.S. Pat No. 6,966,205 which is a continuation-in-part of application Ser. No. 10/666,186 filed Sep. 17, 2003, now U.S. Pat. No. 6,829,916, the contents of which are incorporated herein by reference.

FIELD OF THE INVENTION

The invention relates to locking devices, and more particularly to a locking device for securing sporting equipment and the like to a fixed stationary object in either single or multiple configurations.

BACKGROUND OF THE INVENTION

Recreational and professional scuba divers require numerous accessories for underwater exploring and/or work. The accessories include air tanks, weights, buoyancy compensators, computers, wet suits, float balls/flags, and so forth. All such accessories are necessary for a safe dive and typically consist of the latest in technology. Thus, even if older equipment is used it is meticulously maintained since any failure could result in injury or death. For this reason, most any accessory used in diving is very expensive and, due to the portability of the profession, easily transported.

While many of the accessories can be hidden from the view of a potential thief, some of the accessories are impractical to conceal due to size, weight, space considerations or the inherent dangers associated with concealing some of the items. For instance, scuba tanks are commonly left on the deck of a boat due to problems in storage. Since scuba tanks are expensive and easily moved they make for easy prey by thieves.

Scuba tanks may be left on a deck of a boat due to lack of storage space but more commonly are left on the deck due to dangers associated with attempting to conceal scuba tanks. Scuba tanks are very heavy, weighing approximately 40 pounds when fully charged and contain 3000 pounds per square inch of compressed air. At the upper end of a scuba tank there is a K-valve that should it be broken off, the compressed air would project the K-valve flying at a velocity sufficient to cause death or serious injury to a person struck by it. Consequently, tanks are typically stored in the vertical position in the cockpit of a boat in a holder commonly referred to as a tank rack.

The amount of compressed air utilized by a scuba diver in the course of his underwater activities depends on the depth at which he is diving; greater amounts of air are utilized at greater depths. However, on the average, a diver will utilize a full tank of air in 30–40 minutes. For this reason, a diver will typically employ at least two tanks for any diving expedition. Since it is most unsafe to dive alone, a diver typically travels with at least one other diver which results in at least four scuba tanks that could be stolen if unattended.

There are various known tank racks that are designed to secure a particular size tank and may include provisions for locking of the scuba tanks. The following patents provide examples of scuba tank racks: U.S. Pat. Nos. 3,791,403; 2,122,897; 3,193,778; 3,860,048; 3,693,830; and 1,174,185.

In addition, cable locking devices are known in the art. For instance, Stone, U.S. Pat. No. 3,841,118 discloses a cable lock designed to facilitate locking motorcycles, bicycles, snowmobiles and outboard motors to a post or tree to prevent theft. The cable lock includes an elongated cable and a pair of mating block sections with means for securely locking the same around the cable to form a positively locked loop.

McCrea, U.S. Pat. No. 6,003,348, discloses a cable lock for surfboards. A sleeve fitting is swaged to a length of cable such that a loop is formed at the end of cable. This loop is used to secure the cable to a rack or other stationary component. A block is used to retain the cable around the object itself. The cable passes through a hole in one end of the block, wraps around the object, and slides into a slot in the other end of the block. An end fitting swaged to the cable prevents the cable from sliding out of the slot in a parallel direction. A padlock is used to prevent the cable from sliding out of the slot in a perpendicular direction. A setscrew is used to retain the block to the cable in the desired location.

Lyon et al, U.S. Pat. No. 3,987,653, disclose a locking device for a looped cable which includes a casing in which one end of the cable is anchored and a passageway through the casing through which the other end of the cable can be passed. Within the casing is a cable clamp for reducing the size of the passageway, the clamp being threaded on a screw and movable to change the size of the passageway by rotation of the screw. The screw is rotatable by rotation of a lock mounted in the casing, the lock being rotatable by a key. The clamp cooperates with a bed to define the passageway, the clamp and bed having intercalated pyramidal teeth which can exert a vise-like grip on a cable of normally cylindrical shape.

Gerow, U.S. Pat. No. 6,212,919, discloses an adjustable cable loop locking system for securing two spaced apart articles, such as a boat to dock piling, with a length of flexible cable. The system includes first and second mechanisms slidably disposed on opposite end portions of a cable in which are formed first and second cable loops respectively. A flexible sheath, which may be a conventional hollow hydraulic hose, slidably covers a central portion of cable and is affixed on opposite ends thereof to the first and second mechanisms to fix the distance between the mechanism as measured along the central portion of the cable. The two lead-in portions of the first loop slidably extend through the first mechanism except that one of these lead-in portions which contains a free end of the cable can be selectively locked in a stationary position in the first mechanism by operation of a locking handle when desired. One of the lead-in portions of the second loop which extends from the first mechanism extends slidably through the second mechanism to the second loop, the end of the cable at the end of the second loop being fastened in the second mechanism. The arrangement permits securing two spaced apart articles together while needing to lock only the first of the two mechanisms.

Zakow, U.S. Pat. No. 4,212,175, discloses a lock for items of portable personal property. The lock includes a plurality of cables extending from a locking box which is mountable to a mounting surface. The items of personal property are mounted to the cables, and at least one end of each cable is secured to one of a plurality of nipples disposed within the box. The locking box has an inner box member and an outer box member which are matable to form the box; the width of the opposed side walls of both the inner box member and the outer box member are generally equal, so that jimmying, or forced opening of the box is precluded since the free edges of the side walls of the outer box member are contiguous with the fixed planar surface when the assembled box is mounted to the surface.

Best, U.S. Pat. No. 4,055,973, discloses an equipment lock for laboratory or office equipment and the like. To prevent removal of the items, separate cables are attached to four or more items of such equipment and have circumferentially-grooved end members which are received in separate bores in a single lock body and are locked therein by a key-controlled keeper. The keeper is a key-removable core inserted in a core chamber which partially intersects the cable-receiving bores, so that the core itself engages in the grooves of the cable end members to lock them against retraction. A mounting screw access passage traverses the core chamber, and is blocked by the core in such chamber to prevent access to a mounting screw inserted through such passage.

Leyden, U.S. Pat. No. 5,154,072, discloses a cable lock for securing a plurality of cables having a blocking shoulders on the ends. The cable lock has openings dimensioned to receive the cable shoulders. A cover is mounted for selective movement relative to the housing between a position permitting passage of the cable through the opening to a position preventing passage of the cable through the opening. The housing is secured with a key operated tumbler lock.

Keifer, U.S. Pat. No. 4,598,827, discloses a system for securing display items to a fixture or the like comprising a housing adapted to be secured to the fixture and a plurality of elongated cables for securing the display items to the fixture. Each cable has a means at one end for securing it to the display item and is detachably secured in the housing at its opposite end. The housing includes cable retention and release channels for a plurality of cables. The channels have an enlarged entrance portion and are configured to permit insertion and removal of the opposite ends of the cables so that any one of the cables may be inserted or removed individually. The housing includes a locking means blocking the entrance portion of the channels and a second position permitting removal of the cables.

However, what is lacking in the art is the ability to securely lock single, or a plurality, of scuba tanks to most any tank rack or fixed object as well as secure various accessories.

SUMMARY OF THE INVENTION

In one embodiment, the accessory locking device of the invention comprises a locking plate having a first aperture sized to receive an elongated flexible securement means securable to a stationary object, a second aperture having an elongated slot extending therefrom, and at least one attachment cable having a proximal end permanently attached to the locking plate and a distal end extending therefrom. In accordance with the invention, the attachment cable has a substantially flat configuration and is constructed from at least two steel cords in a spaced apart parallel arrangement which are encased in a flexible plastic casing. The flat attachment cable is sized to be insertable into the second aperture for subsequent positioning in the slot. The flat attachment cable includes at least one locking lug sized for closely aligned insertion into the second aperture. Cable crimps are also located on the attachment cable which are sized for closely aligned insertion in to the second aperture and which have a width greater than the width of the slot.

A locking means is provided which is selectively insertable into the second aperture and movable between locked and unlocked positions. The locking means including a locking member configured to prevent movement of the locking lug or the cable crimps through the aperture when the locking means is in the locked position. In use, the locking means is placed in an unlocked position, and the flat attachment cable is wrapped around an item to be locked and then inserted into the second aperture of the locking plate such that the locking lug, or the locking lug and at least one cable crimp, passes through the second aperture and the at least one attachment cable is transversed for placement into the slot. The locking member of the locking means lock is placed in the locked position to prevent the withdrawal of the locking lug from the aperture. A flexible elongated securement means is then inserted through the first aperture and secured using a locking means to prevent removal of the locking plate from the securement means and the securement means secured to a stationary structure, thereby locking the item to the stationary structure. The flexible elongated securement means can be inserted through a plurality of locking plates, so that a plurality of items to be secured can be secured to a stationary structure.

In a preferred embodiment, the locking means is a key-operated tumbler lock tangentially adjacent the second aperture, and the locking member is a coaxial bolt member operatively associated with said tumbler lock wherein the bolt member extends into the second aperture in said locked position. Alternatively, the locking means can be a conventional padlock inserted through the second aperture and locked with the shackle bar.

In an alternative embodiment, the distal end of the attachment cable can include an aperture adapted to receive the shackle bar of a padlock. The padlock prevents the attachment cable from being withdrawn from the aperture, and allows the locking device to be secured to a fixed structure or another locking device using the attachment cable.

It is an objective of the invention to provide an inexpensive, durable, reliable, and portable means of locking scuba tanks.

It is another objective of the invention to provide a locking device which can conveniently lock scuba tank accessories such as weights, regulators, gauge units, buoyancy compensators, and the like accessories.

It is another objective of the invention to provide a locking device wherein scuba tanks can be securely locked without the necessity of making precise tank positioning adjustments.

Still another objective of the invention is to provide a scuba lock system that can quickly and safely secure scuba tanks and gear, either on the dock, in a vehicle, or anywhere that opportunistic theft is a possibility.

Another objective of the invention is to provide a locking device that can lock scuba tanks of various heights and diameters.

Yet another objective of the invention is to provide a locking device which simultaneously secures a plurality of scuba tanks to a fixed structure, and which also allows individual tanks to be selectively locked and unlocked.

Still another objective of the invention is to provide a locking device which can be used singly to secure an item to a stationary object, or alternatively in combination with an additional cable so that a plurality of locking devices can be secured to a stationary object.

Still another objective of the invention is to provide a locking device having a novel flat attachment cable which enables the cable to be pulled to a smaller radius that standard round cables, making use of a cutting device more difficult.

Still another objective of the invention is to provide a locking device having a novel flat attachment cable which provides more contact with the item to be locked than a standard round cable.

Still another objective of the invention is to provide a locking device having a novel flat attachment cable which enables the cable to be wrapped multiple times around an article to be locked.

Still another objective of the invention is to provide a locking device having a novel flat attachment cable which has less memory than a round cable of comparable size for easier application and more comfortable handling.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
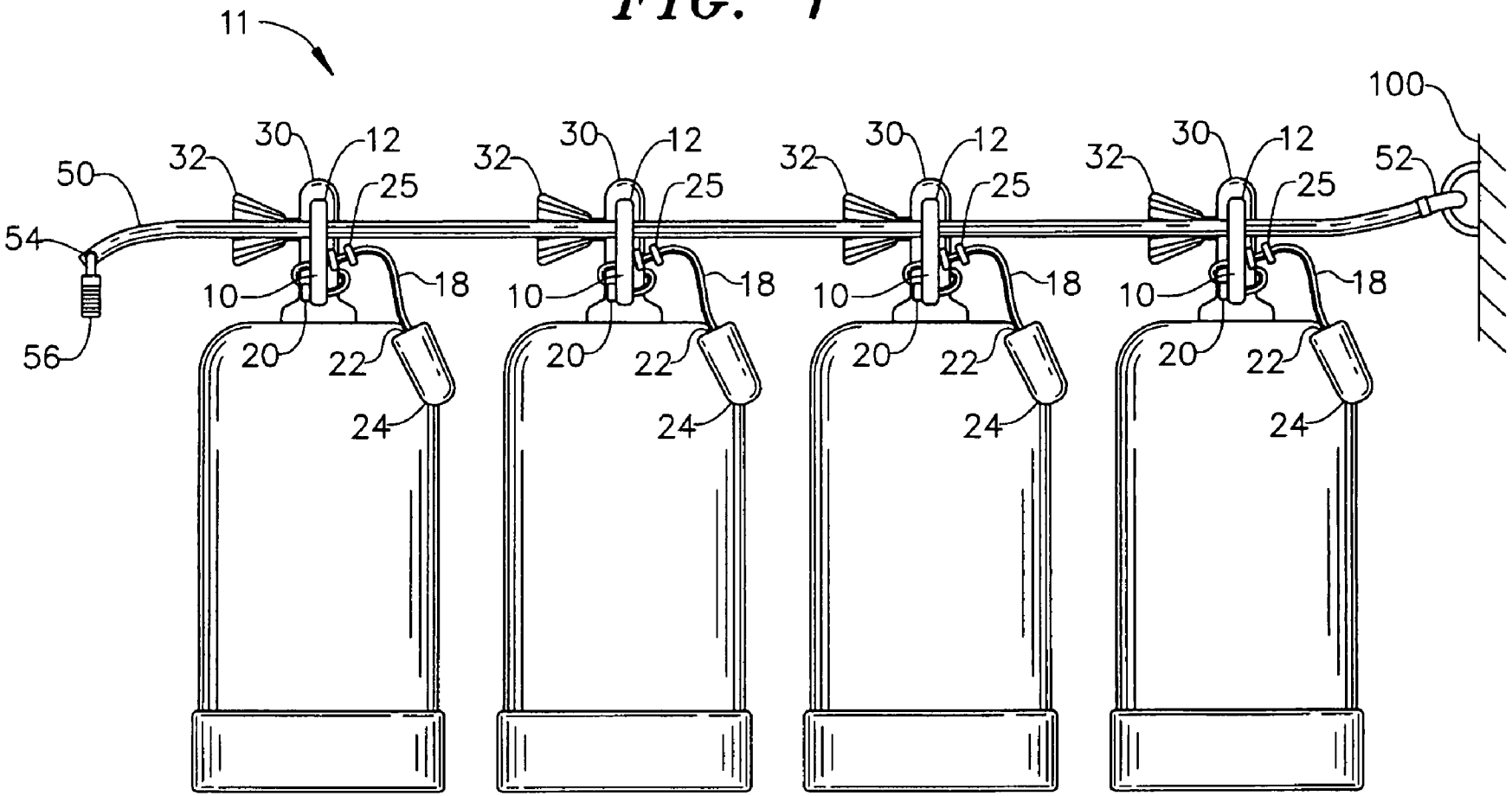
FIG. 1 is a pictorial view of four scuba tanks having a first embodiment of the locking device assembly of the invention which includes a locking device secured to each tank and further secured to a fixed structure.

Now referring to FIG. 1, a locking device assembly 11 is depicted which secures multiple pieces of equipment to a fixed structure 100. The locking device assembly 11 includes a plurality of locking devices 10 secured by an elongated flexible securement means (cable lock 50) which is locked to a stationary structure. The locking device assembly 11 can be used to secure and lock any item (or items) having a suitable configuration. In FIG. 1, the locking device assembly 11 is shown as used with scuba tanks. The scuba tanks consist of cylinders housing compressed air, argon, helium, nitrogen or a mix of thereof. Scuba tanks are available in several standard sizes, the larger of which is an 120 cubic foot capacity tank, 7 and ¼ inches in diameter, and approximately 26 inches high. The most common tank is 80 cubic foot having slightly smaller dimensions. At the upper end of a scuba tank there is a valve commonly called a K-valve 30. The K-valves 30 include a rotatable knob 32 for controlling the release of gas from the tank. The K-valve 30 is subsequently coupled to a hose and air regulator that allows the diver to breath underwater is common between the various size tanks. The present invention provides a locking device 10 for each tank common to the K-valve, thus allowing tanks of various sizes to be locked with the same device.

As will be described in detail hereinafter, each tank has a locking device 10 secured thereto, through which is threaded a flexible elongated securement means which forms part of the locking device assembly 11. In the illustrated embodiment, the flexible elongated securement means is a conventional cable lock 50. A segment of metal link chain can also be used. The cable lock 50 can have a first end 54 having an aperture for receiving the shackle bar of a conventional padlock, and a second attachment end 52 which allows the cable 50 to be attached to a stationary structure. The second attachment end 52 can be in the form of a loop through which the first end 54 can be inserted.

Figure 2A:
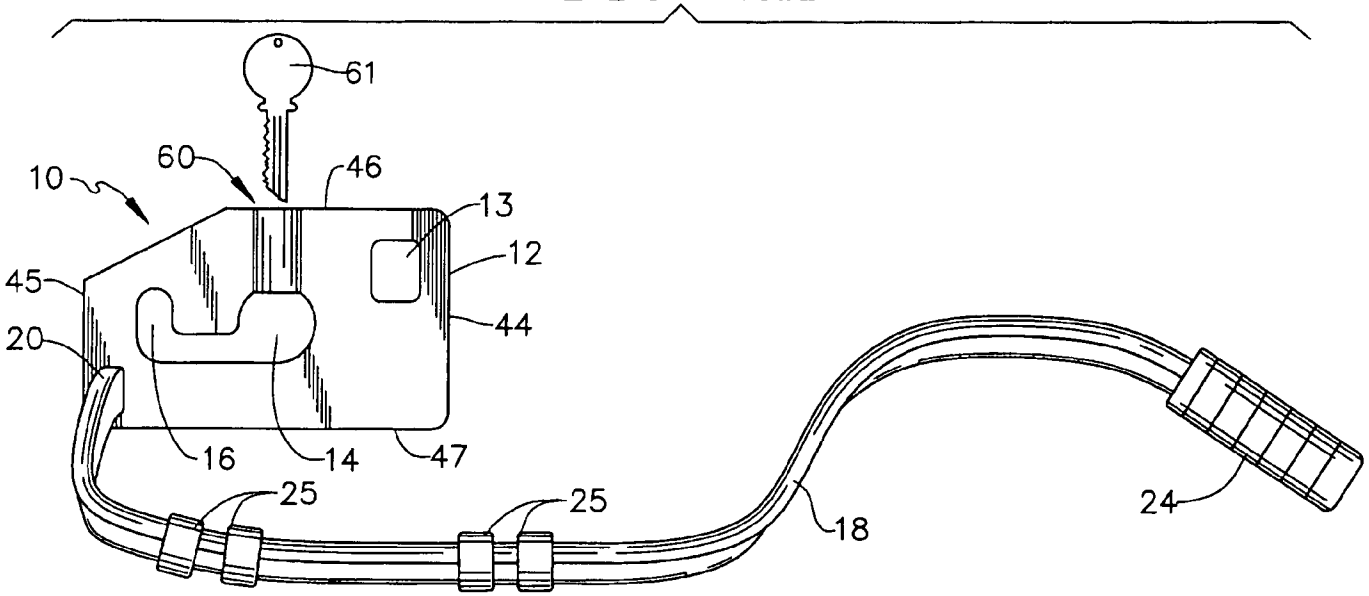
FIG. 2A is a front view of the locking device of FIG. 1, in which the tumbler lock is unlocked.

The locking device 10 is shown in detail in FIGS. 2A, B and 3–4. The locking device 10 includes a locking plate 12, preferably steel, having a top edge 44, a rear edge 45 and opposing side edges 46, 47. A first aperture 13 is positioned near the top edge 44 of the locking plate 12 which is sized to receive the insertion end 54 of the cable 50 (FIG. 1). A second aperture 14 is position in the approximate center of the locking plate 12, and an elongated slot extends 16 outwardly from the second aperture 14 with the width of the elongated slot 16 being less than the width of the second aperture 14. The elongated slot 16 preferably extends toward the rear edge 45.

Figure 2B:
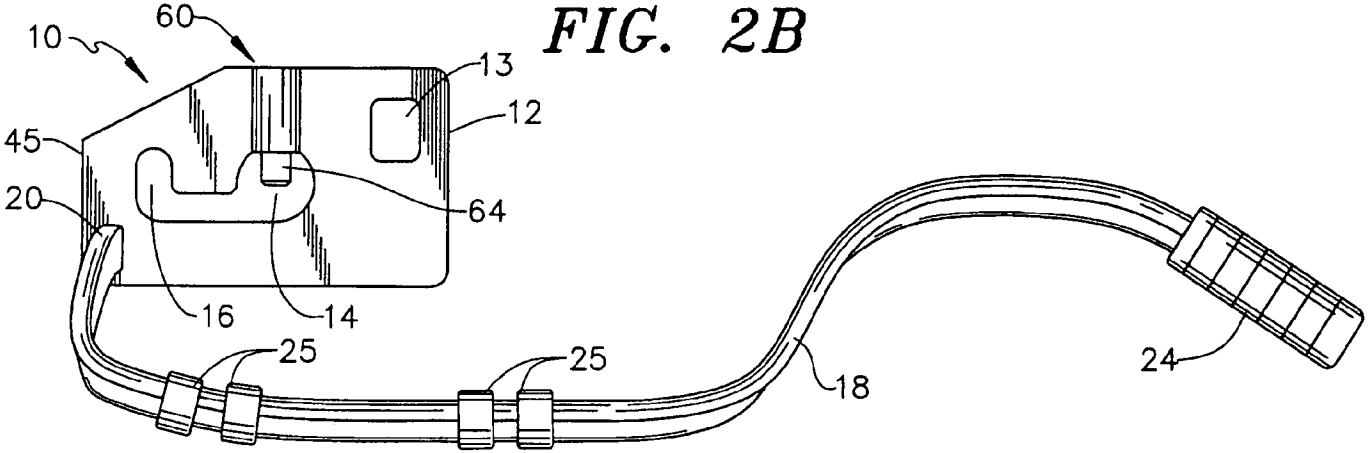
FIG. 2B is a front view of the locking device of FIG. 1, in which the tumbler lock is locked.
Figure 3:
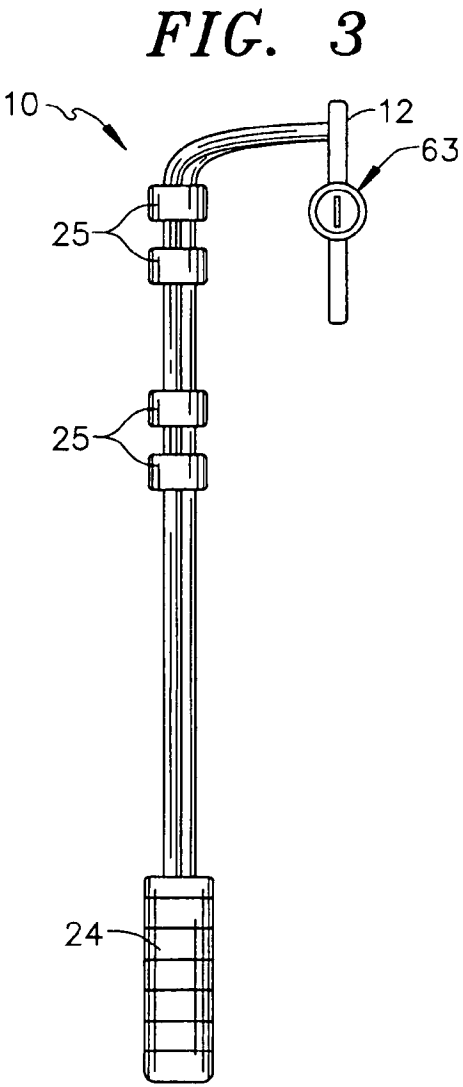
FIG. 3 is a top plan view of the locking device of FIG. 1.

As can be best seen in the top view shown in FIG. 3, the locking plate 12 includes a key-operated cylindrical tumbler lock 60 which is tangentially adjacent the second aperture 14. The cylindrical tumbler lock 60 includes a barrel 63 which is integrally formed with the locking plate 12 and extends from one of the opposing side edges 46, 47 to the second aperture 14. The cylindrical tumbler lock 60 is openable by means of key 61, and includes a coaxial bolt member 64 operatively associated with the key operation thereof. The bolt member 64 is positionable between locked and unlocked positions with the bolt member extending into the second aperture 14 in the locked position as shown in FIG. 2B. In the unlocked position shown in FIG. 2A, the bolt member 64 is retracted into the barrel 63 leaving the second aperture 14 open.

Figure 4:
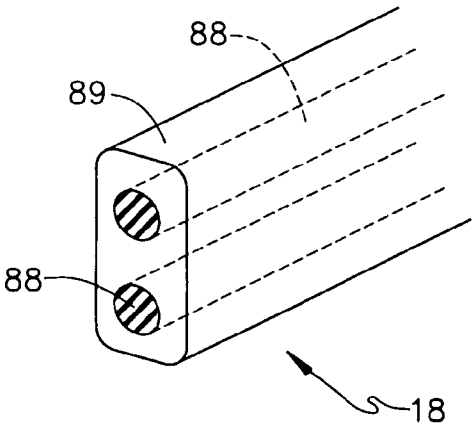
FIG. 4 is a cut-away view of the flat attachment cable of the invention showing the construction thereof.
Figure 5:
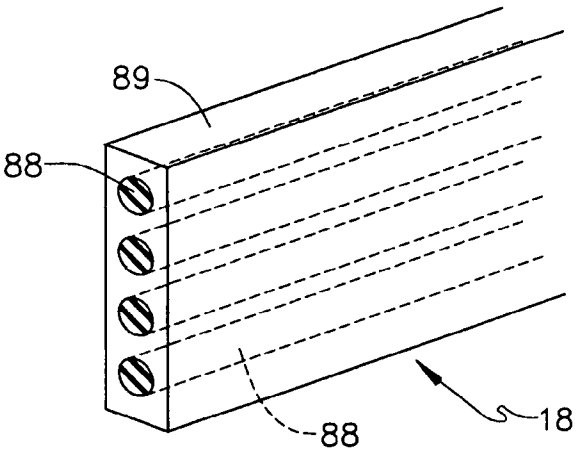
FIG. 5 is a cut-away view of an alternative construction of the flat attachment cable.

The locking device 10 includes at least one attachment cable 18 having a proximal end permanently attached at a point 20 to the locking plate 12 and a distal end extending therefrom. The attachment cable 18 of the present invention has a novel flat configuration, which provides numerous advantages over standard round cables. As can be seen in the cutaway view shown in FIG. 4, the flat attachment cable 18 according to a preferred embodiment of the invention is constructed from at least two steel cords 88 in a spaced apart parallel arrangement which are encased in a flexible plastic casing 89. The steel cords 88 are strands or multi-strands of galvanized stainless or hardened steel wire. In the preferred embodiment, the cords 88 are encased in a polyvinylchloride (PVC) plastic covering that is extruded into a rectangular flat or flattened oval shape. As shown in FIG. 5, multiple cords 88 in a parallel arrangement can be used to create a flat cable of a larger size and increase contact area. The plastic casing 89 is thick enough to hold two or more cords 88 in position without breaking through the plastic covering.

Figure 6:
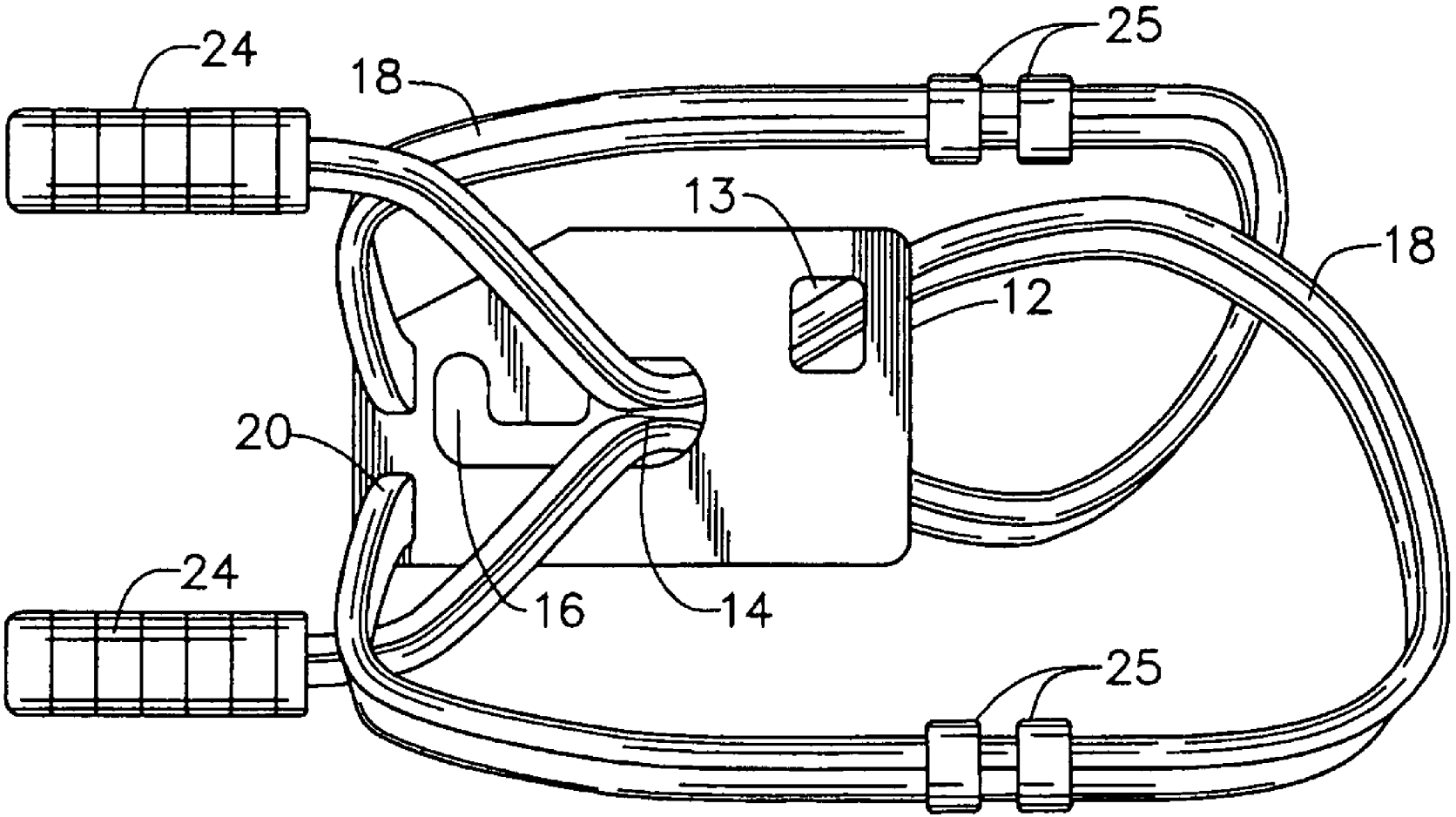
FIG. 6 illustrates an alternative embodiment of the locking device including a plurality of flat attachment cables.

The flat attachment cable 18 is sized to be insertable into the second aperture 14 for subsequent positioning in the slot 16. Attached to the flat attachment cable 18 includes is least one locking lug sized for closely aligned insertion into the second aperture. In the illustrated embodiment, the locking lug is in the form of a end fitting 24 which can operate as a pull handle. As shown in FIG. 6, the locking device 10 can includes multiple attachment cables 18 which are permanently attached to the locking plate 12, which each include an end fitting 24.

Cable crimps 25 are also located on the attachment cable which are sized for closely aligned insertion in to the second aperture 14. The cable crimps 25 have a width greater than the width of the slot 16 and operates as a cable positioner. Multiple cable crimps 25 can be used to provide locking of the cable at any number of positions. In a preferred embodiment, a plurality of cable crimps 25 are evenly spaced on the attachment cable 15. When the cable crimps 25 are suitably positioned in the locking plate 12, the attachment cable 15 can be fixed in length to prevent lengthening as well as shortening of the cable 15 once placed in the slot. This is important when securing diving accessories where movement of the flexible 18 may otherwise provide a thief with the ability to dislodge an accessory. It should be noted that the proximal end 20 may be unattached wherein the flexible attachment cable 18 may be stored independently from the steel plate lock and when use is required, engage the proximal end 20 with the slot 16.

Figure 8:
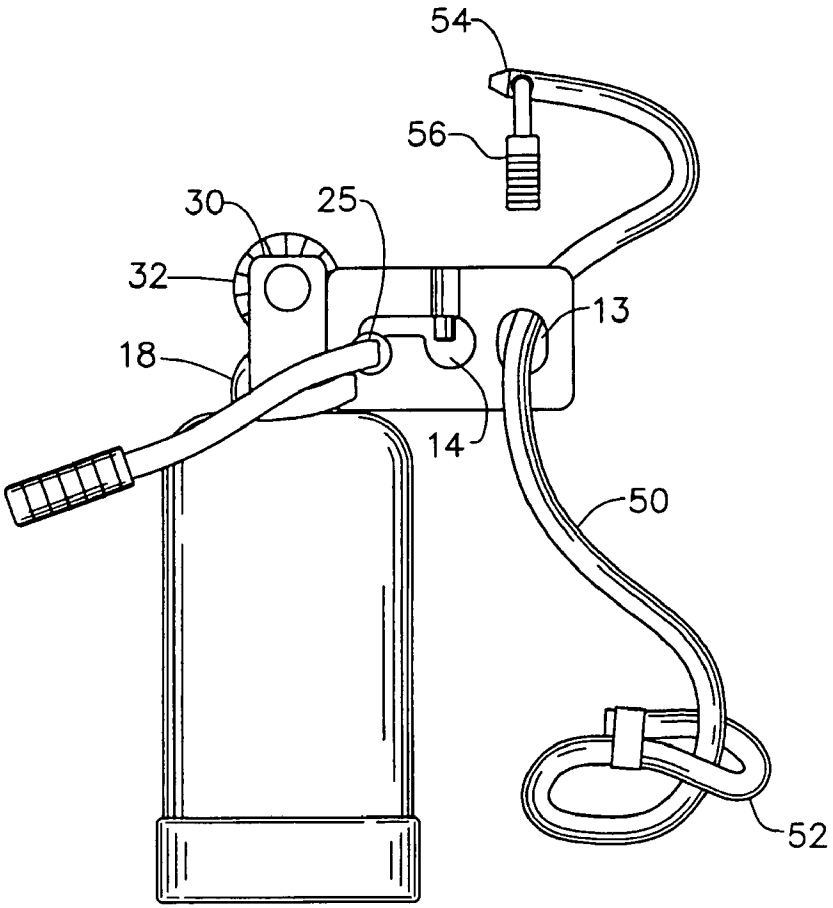
FIG. 8 is a side view of the locking device secured to a scuba tank.
Figure 7:
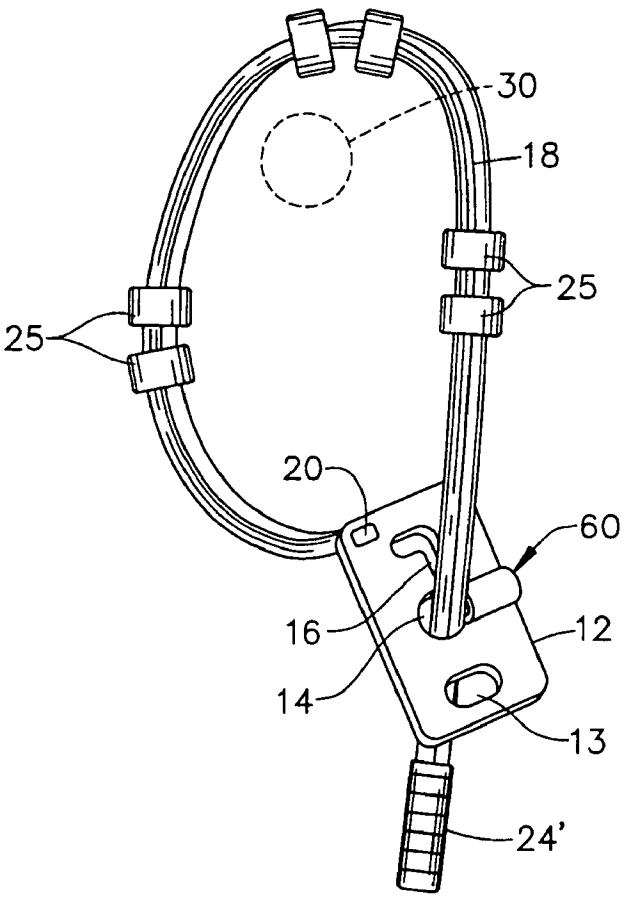
FIG. 7 illustrates the procedure for securing the locking device of FIG. 1 to an item to be locked.

In operation, the bolt member 64 of the key-operated tumbler lock is placed in an unlocked position, thus leaving the second aperture 14 open. As shown in FIG. 7, the distal end of the attachment cable 18 is wrapped around an item to be secured, and then inserted into the second aperture 14 of the locking plate 12 such that the end fitting 24 passes through the second aperture 14. The attachment cable can then be tightened around the object, preferably until and at least one crimp 25 is drawn through the aperture 14. The attachment cable 18 is then transversed for placement into the slot 16, as shown in FIG. 8. The cylindrical tumbler lock is then locked by means of a key, which locking action causes the bolt member 64 to extend downwardly into the locked position. The bolt member 64 prevents the withdrawal of the end fitting 24 or crimp 25 from the second aperture 14, and the locking plate 12 is thus secured to the K-valve 30 in a locking arrangement. The cable lock 50 is secured to a stationary structure using any suitable means, and the insertion end 54 of the cable lock 50 inserted through the first aperture 14 in the locking plate 12, and a padlock 56 is secured though the aperture at the insertion end, thereby locking the scuba tank to the stationary structure. A plurality of locking plate assemblies 10 can be used to lock corresponding number of scuba tanks to the cable lock 50. The locking plate assemblies 10 of the invention advantageously allow individual scuba tanks to be selectively removed from the locking arrangement without unlocking and unthreading the entire contents residing on the cable lock 50.

For security applications, the flat attachment cable 18 of the invention provides numerous advantages over conventional round cables. The flat attachment cable 18 can be pulled into a tighter radius than a single round cord of equivalent size and strength. The flat shape allows the cable to wrap evenly around an object that ordinarily would not be possible to secure with a round cable. The round cable only makes tangential contact with the object, while the flat cable engages with greater surface area on the object. In some cases, it is possible to roll or dislodge a round cable from its original position on the object, making it easier to wedge a cutting device between the object and the cable. The flat cable makes it more difficult to a would-be thief to cut the cable. A standard round cable as is commonly available for locking purposes cannot secure tapered objects such as surf boards, baseball bats, hockey sticks, and the like. The flat attachment cable 18 can secure these objects because it has greater surface contact and flexibility.

The length of the attachment cable 18 can be varied depending on the particular application. Also, the flat configuration allows the cable 18 to be wrapped around an object multiple times. Another advantage of the present invention is that the flat cable 18 has less memory than a standard round cable because it uses multiple cords each having a smaller diameter. Since the flat cable has less memory than a round cable, it is easier to handle and manipulate into position.

In addition, it is possible to use the locking plate assemblies 10 independently of the main locking cable 50. In this arrangement, the shackle bar of a padlock or other suitable locking device can be inserted though the first aperture 13 to secure the locking device 10 to a stationary structure having a suitable configuration.

Figure 9A:
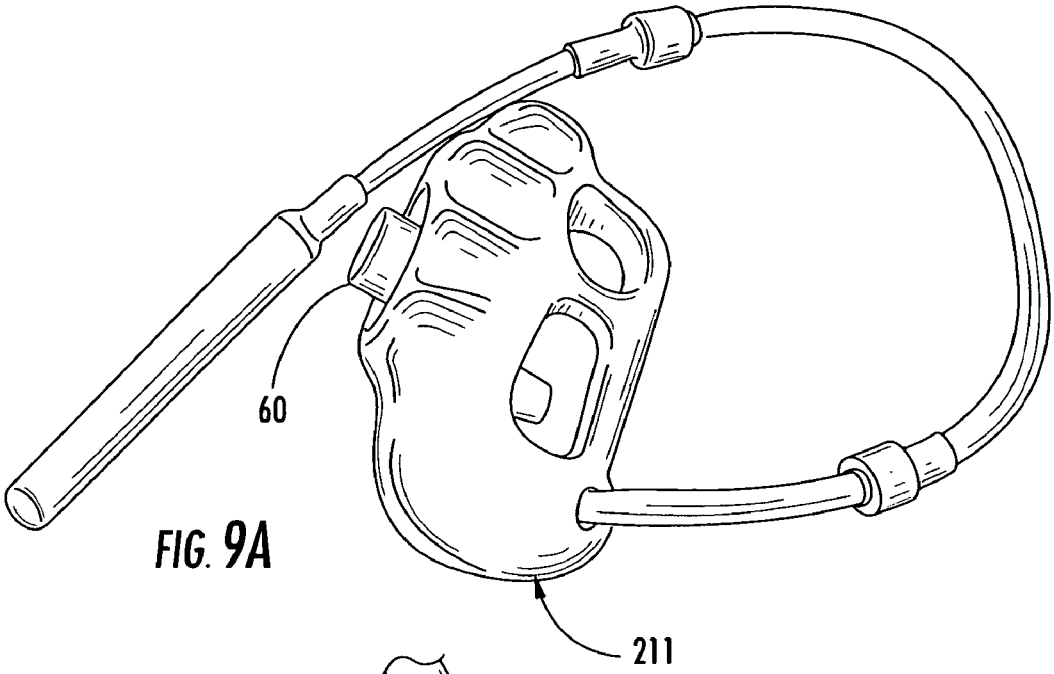
FIG. 9A is a perspective view of an alternative embodiment in which the locking plate of the locking device is encased in injection-molded plastic.
Figure 9B:
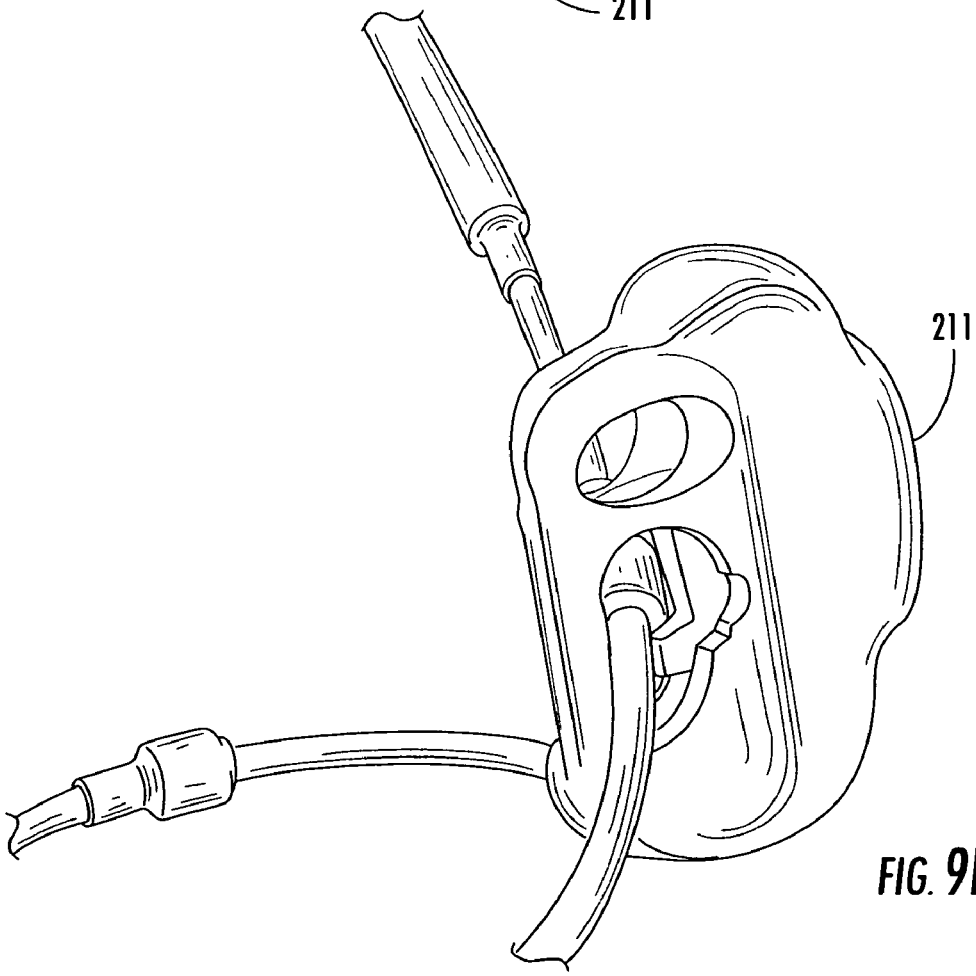
FIG. 9B is a front view of the embodiment shown in FIG. 9A.

FIGS. 9A and 9B depicts the locking plate 12 encased in plastic handle 211, which is preferably injection molded plastic. The plastic handle 211 is contoured to provide an ergonomic gripping surface, and also to provide a more pleasing esthetic appearance. The plastic handle 211 has openings therein which correspond to the first aperture 13, the second aperture 14 and the slot 16 so that they are fully accessible. The plastic handle 211 can be adapted for other embodiments of the locking plate which are described herein. In the embodiment shown in FIG. 9, the plastic handle 211 extends beyond the side edge locking plate 12 to provide a recessed opening for the key-operated tumbler lock 60. The plastic handle 211 can be fabricated in two or injected molded portions which have mated self-locking contact points. The portions can then be set over the locking plate 12 and press-fit to enclose the locking plate 12.

Figure 10:
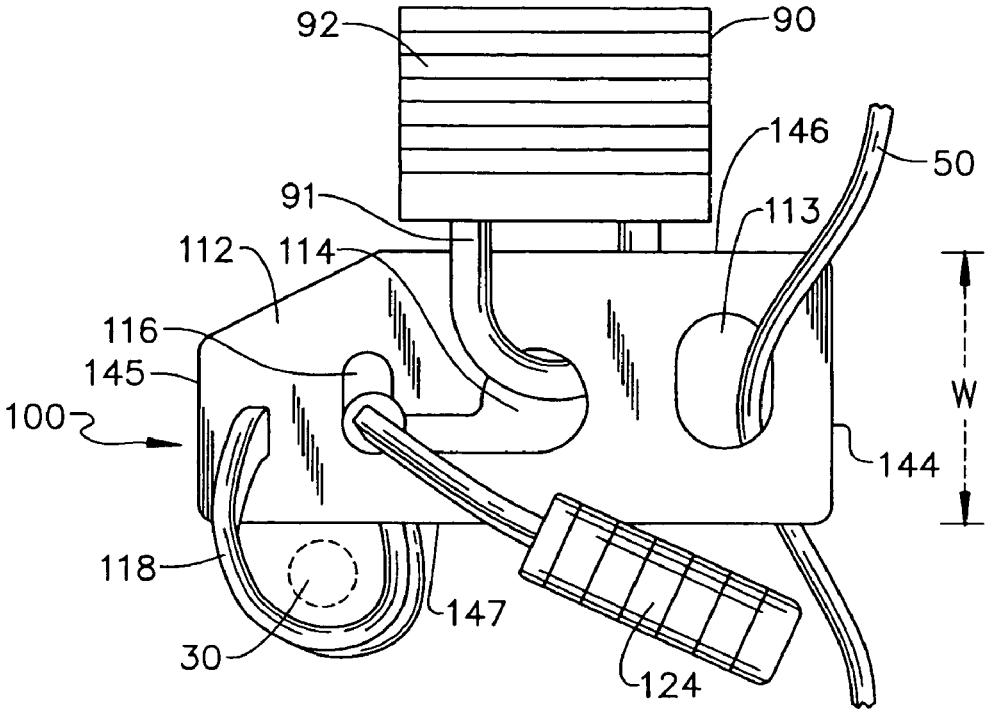
FIG. 10 is an alternative embodiment of the locking device of the invention.

FIG. 10 illustrates another alternative embodiment of the invention depicted as locking device 100. The locking device 100 includes a locking plate 112 similar to that shown in the previous embodiment. The locking plate 112 has a top edge 144, a rear edge 145 and opposing side edges 146,147. The locking plate 112 includes a first aperture 113 positioned near the top edge 144 of the locking plate 112 which is sized to receive the insertion end 54 of the cable 50 and a second aperture 114 positioned in the approximate center of the locking plate 112. An elongated slot 116 extends outwardly from the second aperture 114. The elongated slot 116 preferably extends toward the rear edge 145, and can have an L-shaped configuration. As in the previous embodiment, at least one flat attachment cable 118 is permanently affixed to the locking plate 112 which is constructed and arranged as in the previous embodiment. The flat attachment cable 118 has an end fitting 124 coaxially attached thereto which is sized for closely aligning insertion into the second aperture 114. The cable 118 can include cable crimps 125 to guide and position the cable 118 within the slot 116.

The locking device 100 includes a conventional padlock 90 having a U-shaped shackle bar 91 securable to a locking base 92. In the practice of the, invention, a plurality of locking devices 100 may be used, each with a corresponding padlock 90, and secured with a common cable, as shown in FIG. 1. The shackle bar 91 has a height and a width allowing it to be inserted through the second aperture 114 and secured to the base 92. The width of the locking plate 112 is dimensioned to allow the shackle bar 91 to be inserted through the second aperture 114 and locked so that said locking base is proximate one of opposing side edges 146, 147. The width w of the locking plate 112 is sufficient to ensure that the shackle bar 91 cannot be manipulated into the slot 116 once the padlock 90 is locked in position. The shackle bar 91 thus prevents the withdrawal of the end fitting 124 or the cable crimps 125 through the second aperture 114.

To secure a plurality of scuba tanks using the locking device 118, a locking device 100 and corresponding padlock 90 are provided for each tank to be locked. The padlock 90 is initially unlocked and separated from the locking plate 112. The distal end of the attachment cable 118 is wrapped around a K-valve 30 of the tank, and then inserted into the second aperture 114 of the locking plate 112 such that the end fitting 124 passes through the second aperture. The attachment cable 118 is then transversed for placement into the slot 116, and the shackle bar 91 of the unlocked padlock 90 is inserted through the aperture 114 and locked to the locking base 92. The shackle bar 91 within the aperture 114 prevents the withdrawal of the end fitting 124 or other locking lug from the second aperture 114. The cable lock 50 is then inserted through the first aperture 113 and secured to a stationary structure in the same manner described in connection with the previous embodiment.

Figure 11:
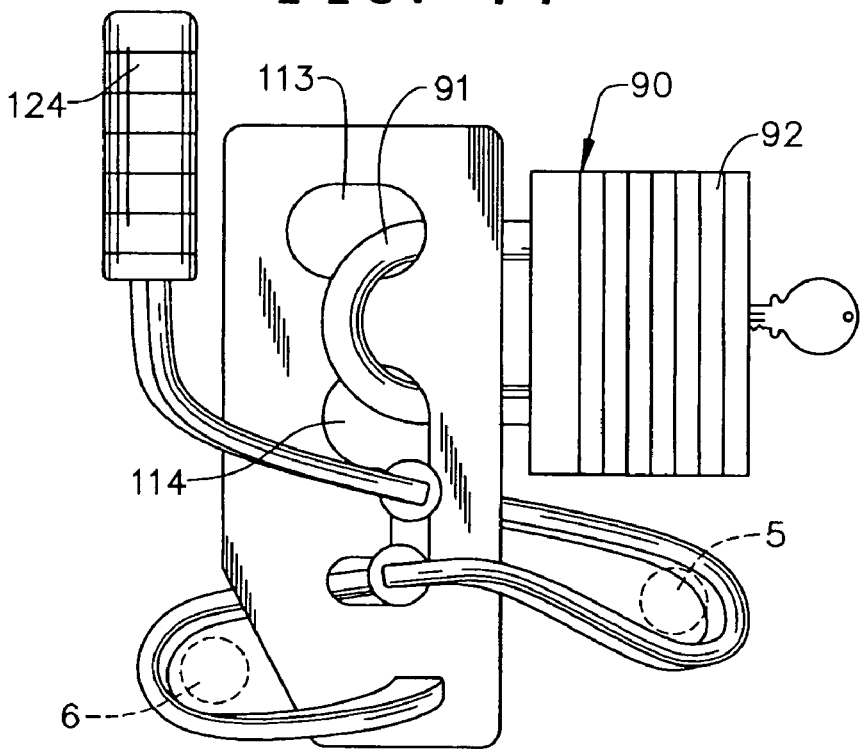
FIG. 11 illustrates an alternative mode of use for the locking device shown in FIG. 7 in which the device is secured to a fixed object using the attachment cable.
Figure 12:
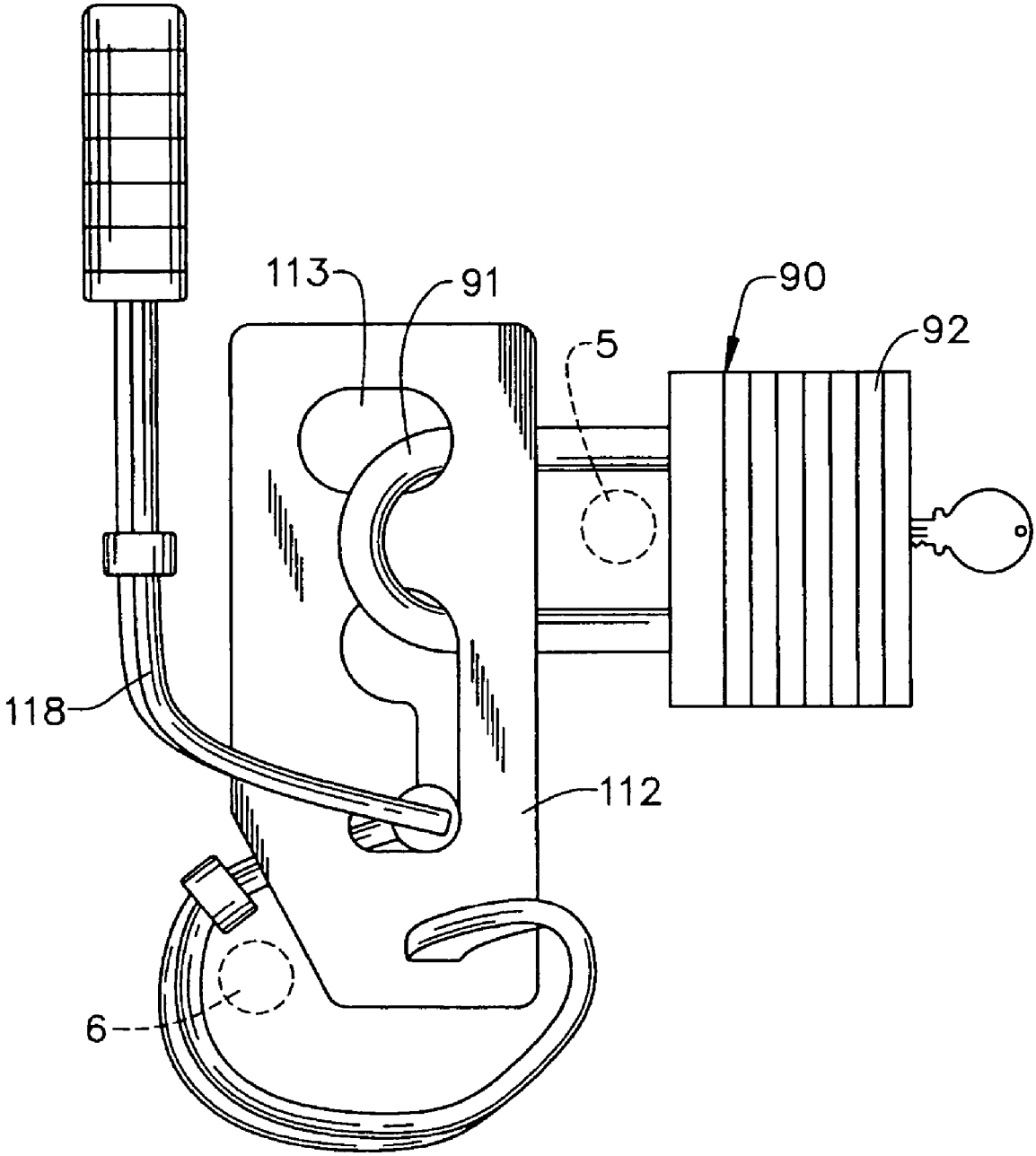
FIG. 12 illustrates an alternative mode of use for the locking device shown in FIG. 7 in which the device is secured to a fixed object using a conventional padlock.

In an alternate mode of use shown in FIG. 11, a single locking device 100 can be used without the cable 50 to secure a single item to a fixed structure 5 such as a fence. The flat attachment cable 118 is wrapped around the item to be secured 6 and the end fitting 124 is inserted through the second aperture 114. The cable 118 is then wrapped around a fixed structure in such a way that it cannot be dislodged, and the end fitting 124 is inserted again through the second aperture 114 in the opposite direction, preferably drawing at least one cable crimp 125 through the aperture 114. The shackle bar 91 of the padlock 90 is then inserted through the first and second apertures 113, 114 and locked to the locking base 92, thus preventing the withdrawal of the end fitting 124. FIG. 12 illustrates yet another method for locking the device 100 to a stationary object which does not require an additional locking cable. In this arrangement, a padlock 90 having an elongated shackle bar 91 is utilized, with the shackle bar 91 being inserted through both the second aperture 114 and a suitable portion of a fixed structure, for example a chain fence.

Figure 13:
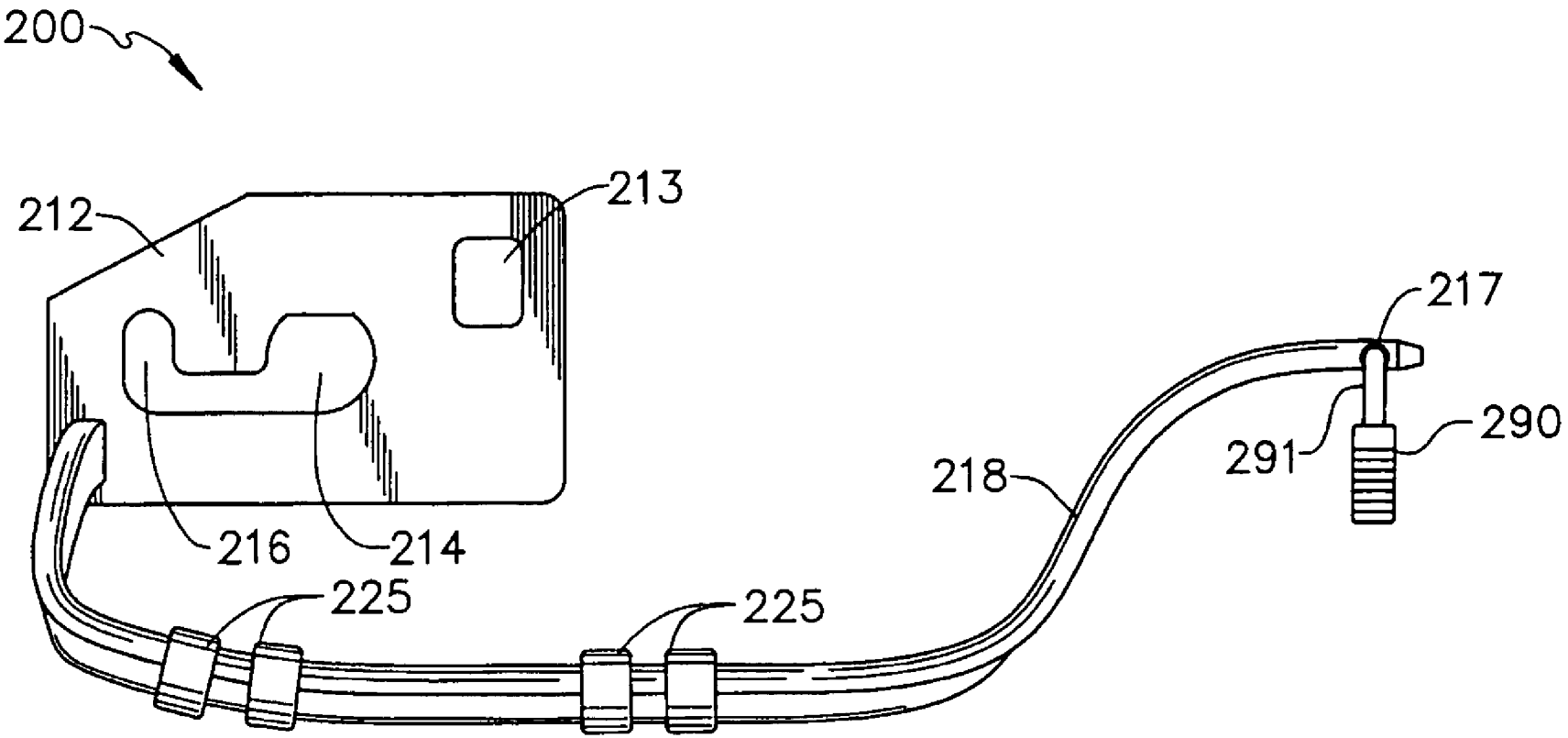
FIG. 13 illustrates another embodiment of the locking device which has an attachment cable adapted to receive a padlock.

FIG. 13 illustrates yet another embodiment of the invention, referred to as locking device 200. The locking device 200 has an locking plate 212 having a first aperture 213 and a second aperture 214 having an elongated slot 216 extending therefrom. At least one attachment cable 218 is fixedly attached to the locking plate 212 which has a width less than the width of the slot 216 and is sized to be freely positionable in the slot 216. The distal end of the cable 218 includes an insertion aperture 217 therein adapted to receive the shackle bar of a padlock. In the preferred embodiment, the cable 218 has a flat configuration, and is constructed and arranged as described above in connection with the previous embodiments.

Figure 14:
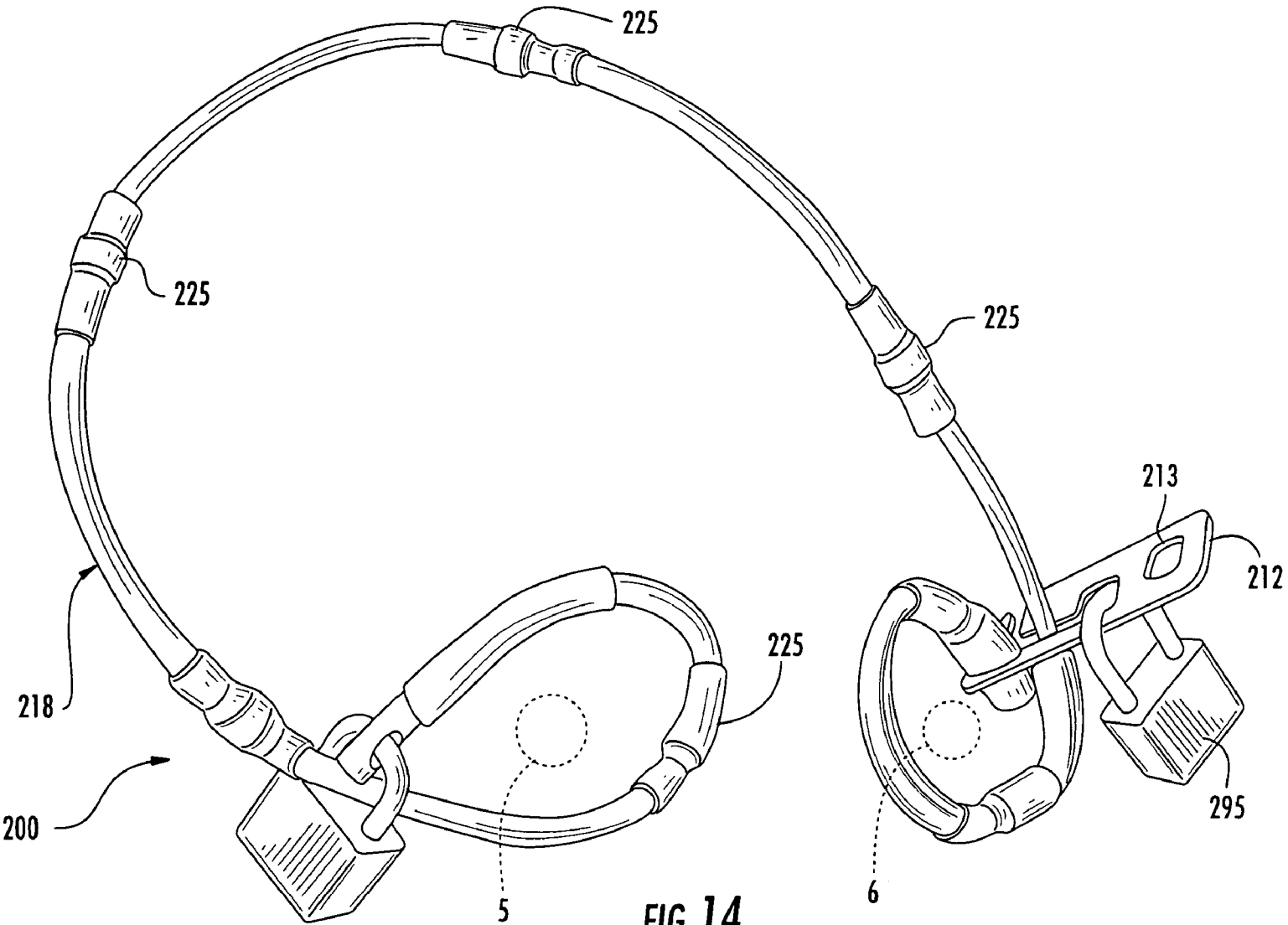
FIG. 14 illustrates a mode of use of the embodiment shown in FIG. 13.

The attachment cable further includes a plurality of cable crimps 225 which are sized for closely aligned insertion into the second aperture 214. The cable crimps 225 have a width greater than the width of the slot 216. FIG. 14 illustrates the use of the locking device 200. The attachment cable 225 is wrapped around an item 6 to be secured, and is then inserted through the second aperture 214 and tightened around the item 6, preferably until at least one cable crimp 225 is drawn through the slot 216. A first padlock 290 can then be locked to the distal end of the cable 225 by inserting the shackle bar 291 through the aperture 217. The cable 225 can be looped through the first padlock 290 to secure the cable 225 to a fixed structure 5. The padlock 290 is larger than the second aperture 214 so that the cable 225 cannot be withdrawn from the aperture.

A locking means is used to partially obstruct the second aperture 214 to prevent the cable 225 from being maneuvered out of the slot 216. In the illustrated example, the locking means is a shackle bar of a second padlock 295 which is inserted and locked through the second aperture 214. A larger padlock 295 can also be used to which has a shackle bar which can be inserted through the second aperture 214 and also secured to another structure. The locking means can also be a length of locking cable inserted through the second aperture 214 and secured so that the locking plate 212 cannot be removed from the locking cable. The attachment cable 225 from another locking device 200 can also serve as the locking means when the devices are used in tandem. The locking means can also be a tumbler lock arrangement similar to that shown in the embodiment illustrated in FIGS. 2A and 2B.

The illustrated locking arrangements are only exemplary as the locking devices of the invention can be used in any desired configuration to secure any item or items as is practical in a given setting. It will be appreciate that when a plurality of locking devices 200 are used in combination, any number of locking arrangements can be achieved.

Figure 15:
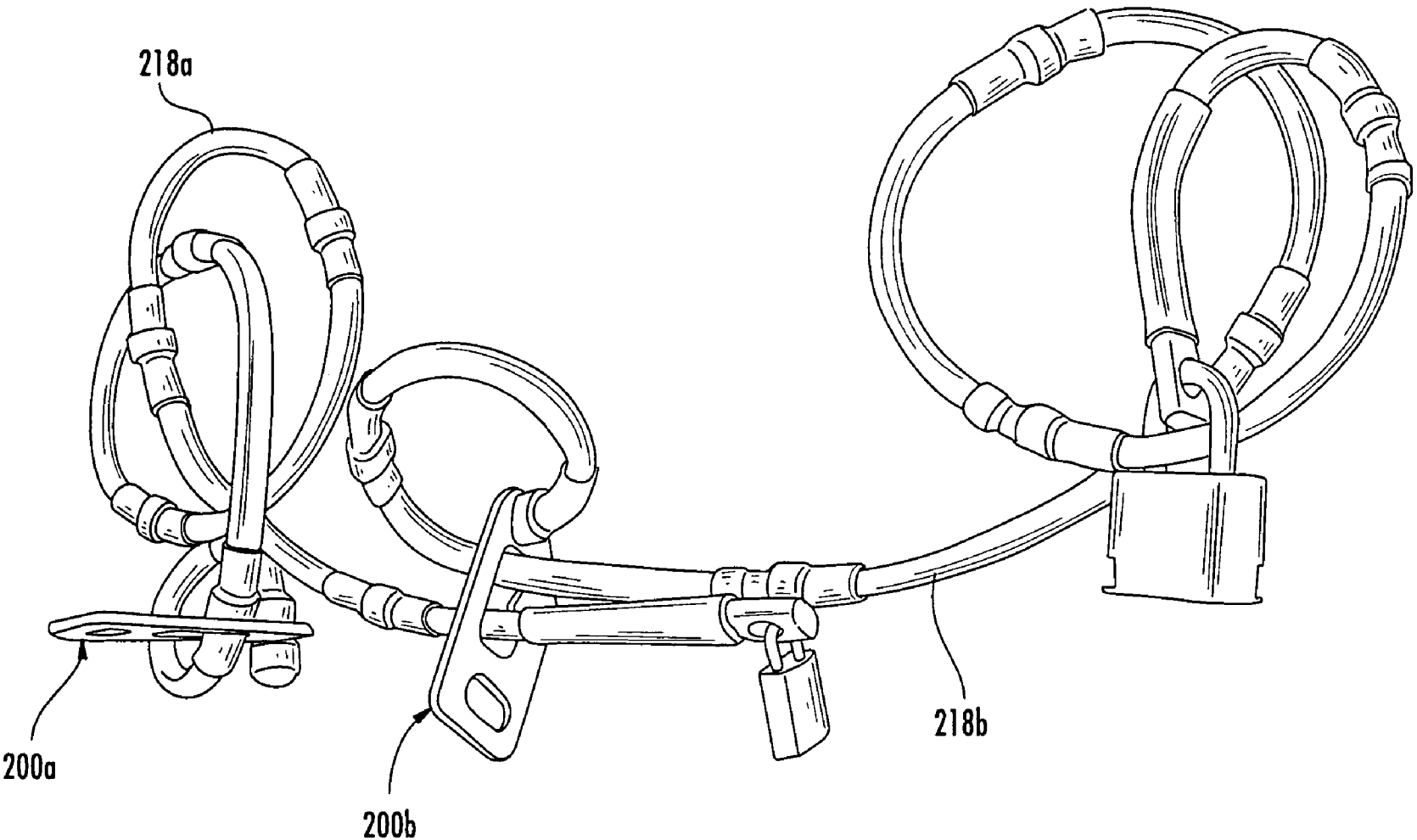
FIG. 15 illustrates a plurality of the locking devices shown in FIG. 13 in a serial connection arrangement.

FIG. 15 illustrates an arrangement with multiple locking devices 200 connected in series. A first device 200*a* can be attached to an item to be locked, with the attachment cable being inserted through the second aperture of a second device 200*b* to provide the locking means, with a first padlock locked to the distal end of the cable. The attachment cable can then secured to a fixed structure using a second padlock which is inserted through the aperture in the distal end of cable.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

I claim:

1. An accessory locking device comprising:

a locking plate having a first aperture sized to receive an elongated flexible securement means securable to a stationary object and a second aperture having an elongated slot extending therefrom, said slot having a width;

at least one attachment cable having a proximal end permanently attached to said locking plate and a distal end extending therefrom, said attachment cable comprising at least two steel cords in a spaced apart parallel arrangement encased in a unitary flexible plastic casing extending between said proximal end and said distal end, said flexible plastic casing having a substantially flat configuration and having a width less than said width of said slot and sized to be freely positionable in said slot;

said at least one attachment cable including at least one locking lug attached thereto wherein said locking lug is sized for closely aligned insertion into said second aperture;

said at least one attachment cable further including at least one cable crimp attached thereto sized for closely aligned insertion into said second aperture and having a width greater than said width of said slot, and locking means selectively insertable into said second aperture and movable between locked and unlocked positions, said locking means including a locking member configured to prevent movement of said at least one locking lug through said second aperture when said locking means is in said locked position;

whereby said locking means is placed in an unlocked position, and said distal end of said at least one attachment cable is wrapped around an item to be locked and inserted into said second aperture and said at least one attachment cable is transversed for placement into said slot, whereupon said locking member of said locking means is placed in said locked position thus preventing the withdrawal of said locking lug from said second aperture, and a flexible elongated securement means is inserted through said first aperture and secured using a locking means to prevent removal of said locking plate from said securement means and said securement means secured to a stationary structure, thereby locking the item to the stationary structure.

2. The accessory locking device of claim 1, wherein said locking means is a key-operated tumbler lock tangentially adjacent said second aperture, and said locking member is a coaxial bolt member operatively associated with said tumbler lock wherein said bolt member extends into said second aperture in said locked position.

3. The accessory locking device of claim 1, wherein said locking means is a conventional padlock, and said locking member is a shackle bar of said padlock wherein said shackle bar is insertable through said second aperture.

4. The accessory locking device of claim 1, wherein said locking lug is positioned at the distal end of said attachment cable.

5. The accessory locking device of claim 4, wherein said locking lug is formed as a handle whereby said handle facilitates grasping the flexible cable and positioning thereof.

6. The accessory locking device of claim 1, wherein said locking plate is a steel plate.

7. The accessory locking device of claim 1, wherein said at least one attachment cable comprises a plurality of cables.

8. The accessory locking device of claim 1, wherein said steel cords comprise multi-stranded galvanized steel wire.

9. The accessory locking device of claim 1, wherein said plastic casing is extruded polyvinyl chloride (PVC).

10. The accessory locking device of claim 1, wherein said plastic casing is extruded into a rectangular shape.

11. The accessory locking device of claim 1, wherein said plastic casing is extruded into a flattened oval shape.

12. The accessory locking device of claim 1, wherein said locking plate is encased in molded plastic.

13. The accessory locking device of claim 1, further comprising said flexible elongated securement means having a first end forming a lockable insertion end and a second end forming an attachment end, said lockable insertion end having an aperture receptive to the shackle bar of a padlock, said attachment end having a attachment aperture whereby said flexible securement means can be fixedly secured to a stationary structure.

14. An accessory locking device comprising:

a locking plate having an aperture therein, said aperture having an elongated slot extending therefrom having a width;

at least one attachment cable having a width less than said width of said slot and sized to be freely positionable in said slot, said at least one attachment cable having a proximal end permanently attached to said locking plate and a distal end extending therefrom wherein said distal end includes an insertion aperture therein adapted to receive the shackle bar of a padlock;

said at least one attachment cable further including a plurality of cable crimps attached thereto sized for closely aligned insertion in to said aperture and having a width greater than said width of said slot, a locking means insertable into said aperture configured to obstruct a portion of said aperture in a locked position; and a padlock having a shackle bar insertable into said aperture of said distal end;

whereby said at least one attachment cable is wrapped around an item to be locked and said distal end is inserted into said aperture of said locking plate and said cable is tightened around said item, and said at least one attachment cable is transversed for placement into said slot, whereupon said locking means is placed in said locked position thus preventing the withdrawal of said cable from said slot, and said padlock is locked to said distal end.

15. The accessory locking device of claim 14, wherein said attachment cable comprises at least two steel cords in a spaced apart parallel arrangement encased in a flexible plastic casing, said flexible plastic casing having a substantially flat configuration.

16. The accessory locking device of claim 14, wherein said locking means is a key-operated tumbler lock tangentially adjacent said aperture, said tumbler lock including a coaxial bolt member operatively associated with said tumbler lock wherein said bolt member extends into said aperture in said locked position.

17. The accessory locking device of claim 14, wherein said locking means is a conventional padlock having a shackle bar insertable through said aperture.

18. The accessory locking device of claim 14, wherein said locking means is a length of steel cable insertable through said aperture.

19. The accessory locking device of claim 14, wherein said locking plate is a steel plate.

20. The accessory locking device of claim 15, wherein said steel cords comprise multi-stranded galvanized steel wire.

21. The accessory locking device of claim 15, wherein said plastic casing is extruded polyvinyl chloride (PVC).

22. The accessory locking device of claim 15, wherein said plastic casing is extruded into a rectangular shape.

23. The accessory locking device of claim 15, wherein said plastic casing is extruded into a flattened oval shape.

24. The accessory locking device of claim 14, wherein said locking plate is encased in molded plastic.

25. The accessory locking device of claim 14, wherein said at least one attachment cable comprises a plurality of cables.

* * * * *